US006341402B2

(12) United States Patent
Lindquist et al.

(10) Patent No.: US 6,341,402 B2
(45) Date of Patent: Jan. 29, 2002

(54) DEVICE FOR A VACUUM CLEANER

(75) Inventors: Tommy Lindquist, Farsta; Curt Nyberg, Tyresö; Johann Zita, Stockholm, all of (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/728,055

(22) Filed: Dec. 1, 2000

(30) Foreign Application Priority Data

Dec. 3, 1999 (SE) ..... 9904399

(51) Int. Cl.[7] ..... A47L 5/36
(52) U.S. Cl. ..... 15/310; 15/334
(58) Field of Search ..... 15/310, 334, 331

(56) References Cited

U.S. PATENT DOCUMENTS 1,785,873 A 12/1930 Muller
1,870,887 A * 8/1932 Bernhard ..... 15/310
2,219,911 A * 10/1940 Wells ..... 15/310 X
2,240,107 A * 4/1941 Wells ..... 15/331
2,247,579 A * 7/1941 Frederick ..... 15/331
2,718,655 A * 9/1955 Cymara ..... 15/310
3,030,650 A * 4/1962 Kiraly ..... 15/310
3,056,933 A * 10/1962 Lewis ..... 15/310

FOREIGN PATENT DOCUMENTS

DE 1 900 890 8/1970

* cited by examiner

*Primary Examiner*—Chris K. Moore
(74) *Attorney, Agent, or Firm*—Pearne & Gordon LLP

(57) ABSTRACT

A device for a vacuum cleaner having a vacuum source communicating with an inlet channel and an outlet channel for air flowing through the vacuum cleaner. The vacuum cleaner includes a holder (19) for a dust pick-up tool such as a feather-duster (20) or a micro fiber-type duster/. The holder is provided with a chamber (21) which, by operation of a valve (28,30), can be connected to the inlet or outlet channel so that the dust pick-up tool is cleaned by the air flowing through the chamber.

11 Claims, 3 Drawing Sheets

DEVICE FOR A VACUUM CLEANER

BACKGROUND OF THE INVENTION

1. Field of the Invention

The invention relates to a device for a vacuum cleaner having a vacuum source communicating with an inlet channel and an outlet channel for air flowing through the vacuum cleaner.

2. Description of Related Art

Vacuum cleaners are used to remove dust and dirt particles from floors by means of conventional floor nozzles. Different accessories are know for facilitating the use of the vacuum cleaner for drawing dust and dirt from furniture, shelves and other types of objects. These accessories usually comprise a brush nozzle, which is placed on the vacuum cleaner tube handle. The tube handle is, via a flexible hose, connected to the vacuum cleaner housing. The brush nozzle is however, together with the associated hose and tube handle, often regarded as too cumbersome or indelicate to be used for cleaning of shelves and other surfaces on which there are fragile objects or objects that are tightly packed.

Instead dusters or feather-dusters are used for cleaning such surfaces. Feather-dusters have the advantage that they comprise many light and flexible fibers and/or thread shaped elements that are bent away when touching the objects such that the feather-duster can reach in between and more or less surround the objects being cleaned. The feather-dusters and so-called micro fiber dusters are designed such that they are charged with static electricity when being used. This means that dust particles when being removed from the surface adhere to the feather-duster. The drawback with these feather-dusters as well as all types of dusters is however that the operator regularly has to go to a space where the operator can shake the feather-duster or the duster such that the dust which is adhered comes loose.

SUMMARY OF THE INVENTION

A purpose of the present invention is to achieve a system for using a feather-duster or a duster together with a vacuum cleaner thereby integrating vacuum cleaning and dusting in one comprehensive rational working operation. In accordance with the present invention, the feather-duster or the duster is always accessible during vacuum cleaning while a hygienic cleaning of the feather-duster or the duster is safeguarded in association with the vacuum cleaner.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
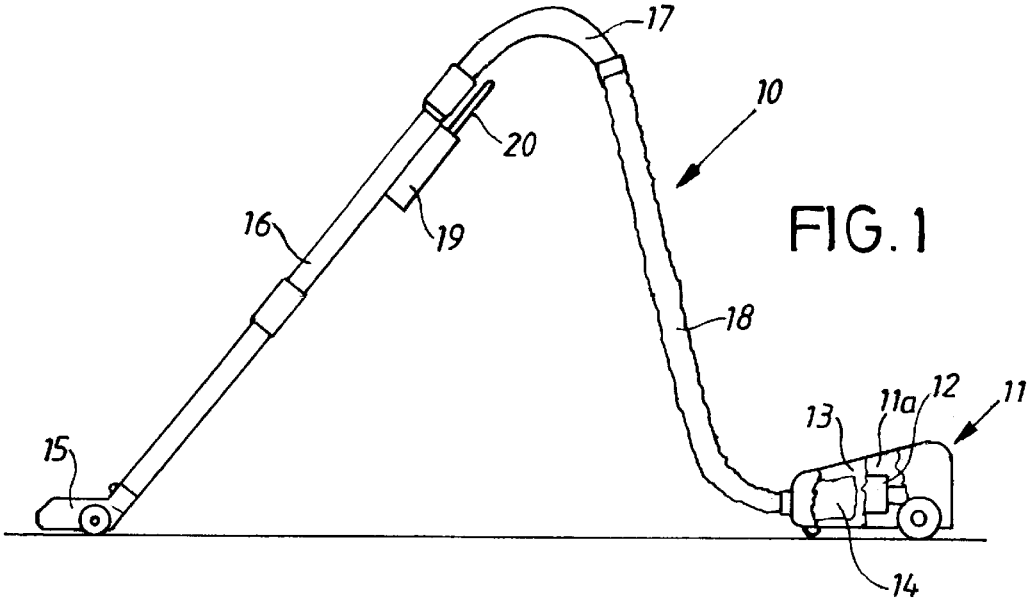
FIG. 1 is a schematic side view of a first embodiment of the invention showing a vacuum cleaner provided with a device according to the invention.

The vacuum cleaner 10 shown in FIG. 1 has a vacuum cleaner housing 11 with a vacuum source 12, preferably a motor-fan unit, communicating with a separation container 13. The separation container 13 surrounds an air permeable bag 14, a cyclone separator or the like in which the dust and the dirt particles are separated from the dust-laden air flow. The dust-laden air flow flows from a nozzle 15 via a tube shaft 16, a tube handle 17, and a hose 18 into the separation container 13. Thus, the lastmentioned parts 15,16,17,18 and 13 form an inlet channel for the dust-laden air. The air passage 11*a* after the motor-fan unit, as seen in the flow direction, forms an outlet channel for the cleaned air entering the atmosphere.

The tube shaft 16 supports a holder 19 for a feather-duster 20 close to the tube handle 17. The holder 19 preferably forms a cylindrical chamber 21 that, at its upper wall part, has several tangentially directed air inlets 22 and, at its lower wall part, additional air inlets 23. The holder 19 also has a closed bottom part 24 and a roof part 25. The roof part 25 has a central opening 26 through which the feather-duster 20 can be inserted into the holder 19.

Between the tube shaft 16 and the holder 19 there is an outlet 27 through which air can flow from the chamber 21 to the tube shaft 16. During a normal vacuum cleaning operation the outlet 27 is closed by a cover 28 that is turnably supported by a hinge 29. The cover 28 is connected to a flap 30 that, during normal vacuum cleaning operation, does not prevent air from flowing through the tube shaft 16. The cover 28 is under the influence of a spring 31 that biases the cover 28 toward a closed position. The cover 28 also includes an extending flange 32 that is acted on by the feather-duster 20.

The device operates in the following manner. During a normal vacuum cleaning operation the feather-duster is stored in the holder in a partly inserted position. In the partly inserted position the feather duster 20 does not engage the flange 32. This means that the dust laden air can freely flow through the tube shaft 16 from the nozzle 15 to the vacuum source 12. When the operator comes to a place where the feather-duster 20 shall be used, the feather duster 20 it is drawn out from the holder 19. After the dusting operation, the feather-duster is again inserted into the holder 19. The operator may choose to insert the feather-duster partly into the holder, which means that the feather-duster will not be cleaned and vacuum cleaning can be made as before. Alternatively, the operator may choose to insert the feather-duster completely into the holder.

Figure 2:
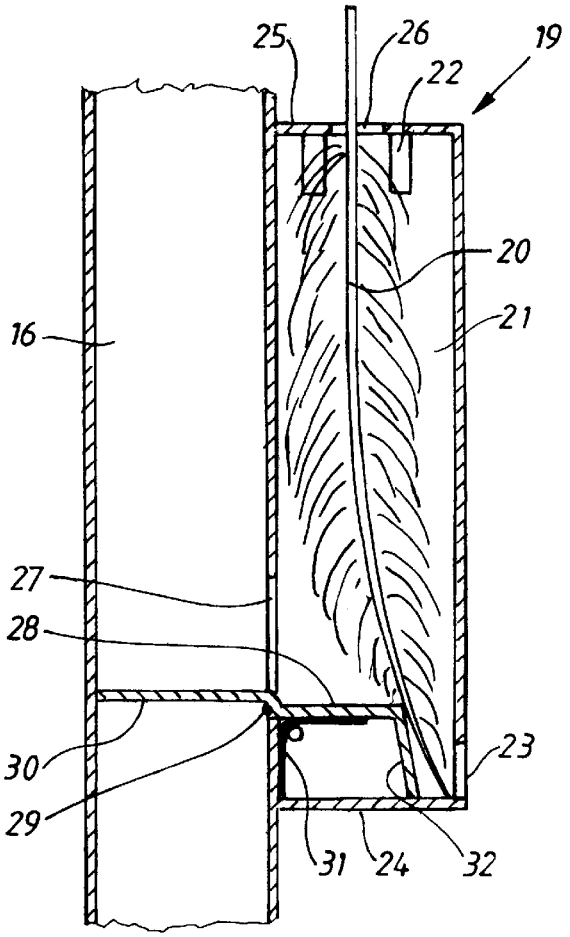
FIG. 2 is a vertical section through the inventive device.

If the feather-duster 20 is inserted completely into the holder 19 it will, during its movement, act on the flange 32 such that the cover 28 and, hence, the flap 30 is turned clockwise about the hinge 29 to the position shown in FIG. 2 in order to open the outlet 27. If the vacuum cleaner is now activated, air will be drawn in through the inlet 22 and 23, through the chamber 21, and through the outlet 27 to the upper part of the tube shaft 16, and then through the tube handle and the hose into the bag 14. The air flowing through the chamber will thus draw the dust from the feather-duster and simultaneously shake the flexible thin threads of the feather-duster. Accordingly, the dust collected by the feather-duster leaves with the air flow and is later separated in the bag 14. Simultaneously, the threads are charged electrostatically since they are shaken and rubbed against the surrounding wall. The feather-duster can then be partly removed from the holder 19 to thereby close the cover 28 and stop the air flow through the chamber. The feather-duster is again ready to be used.

Figure 3:
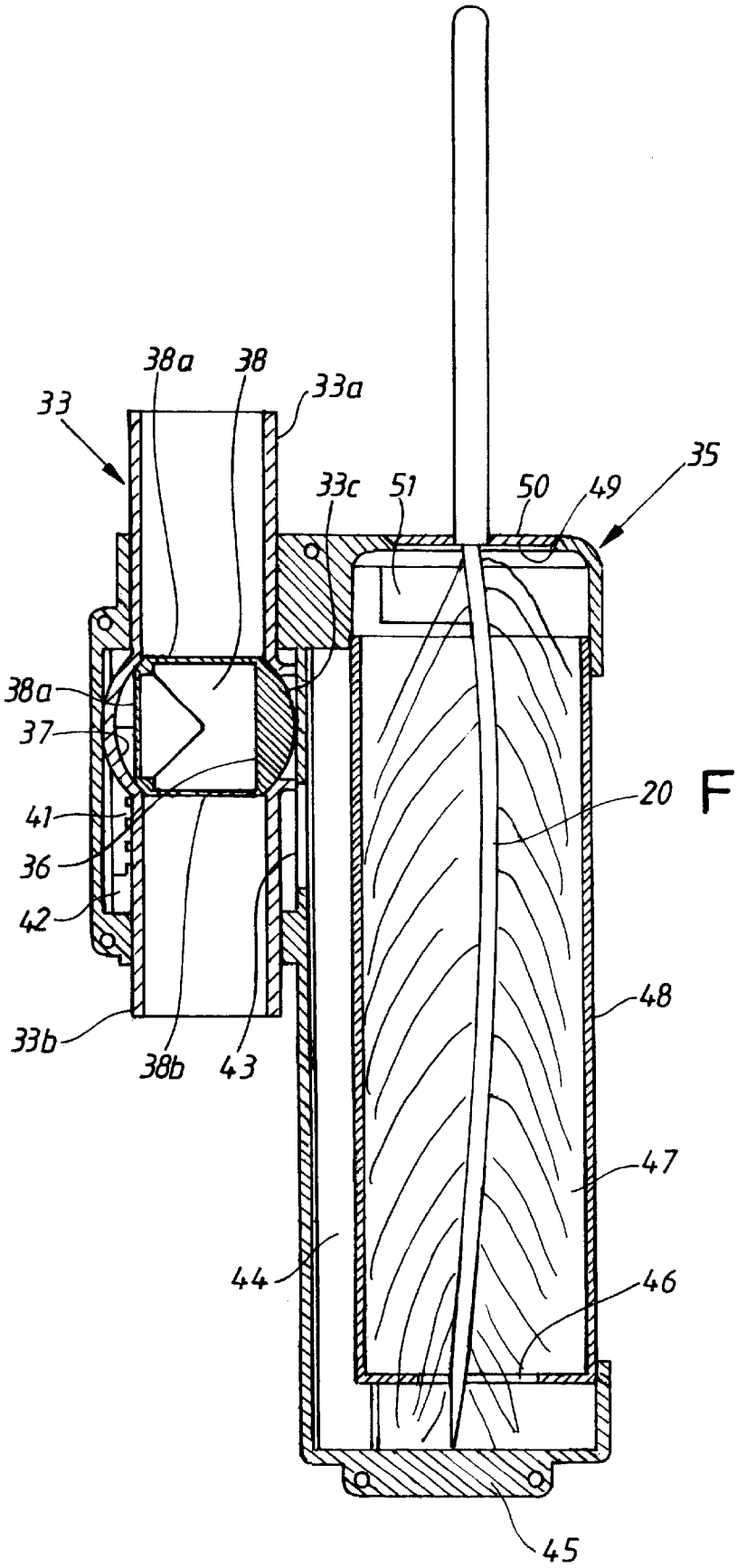
FIG. 3 is a longitudinal section of a second embodiment of the invention.
Figure 4:
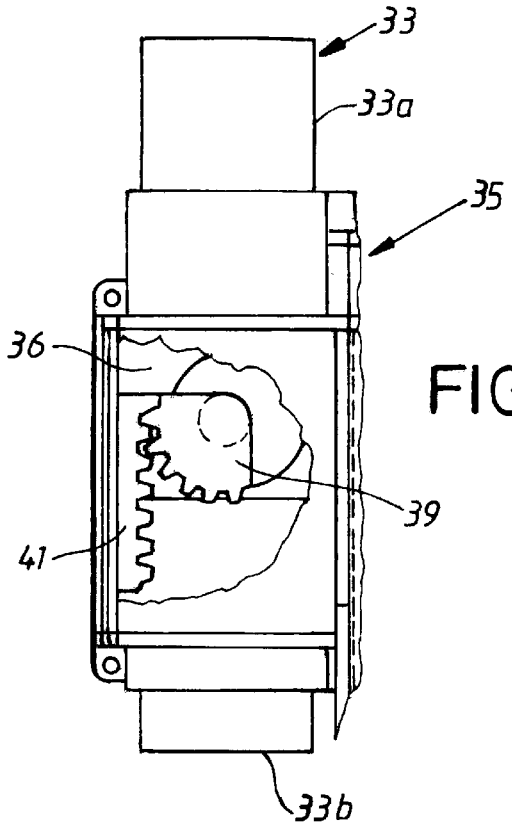
FIG. 4 is a partly-broken view of a part of the device shown in FIG. 3; and, FIG. 5 is a schematic perspective view showing a section of the embodiment according to FIGS. 2 and 3.
Figure 5:
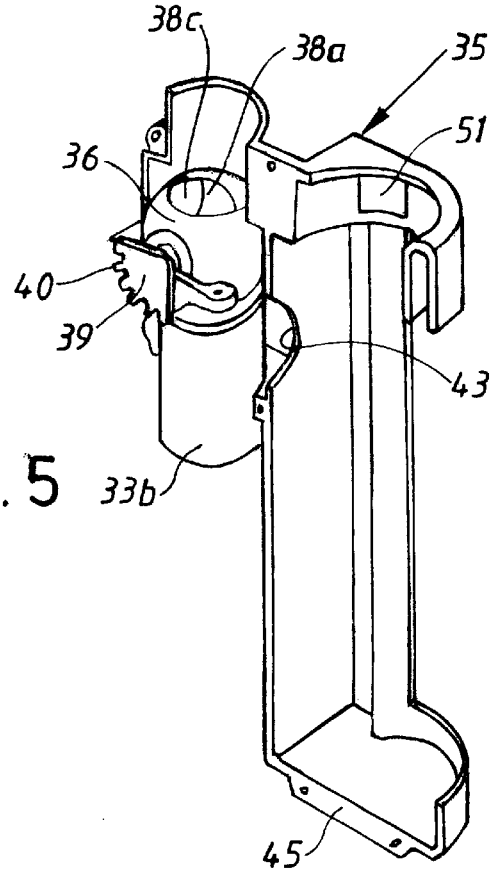

The second embodiment shown in FIGS. 3–5 comprises a tube part 33 which has an upper portion 33*a* that is connected to a tube handle (not shown) and a lower portion 33*b* which is connected to a tube shaft (not shown). The tube part 33 is slidably arranged on a holder 35 for the feather-duster 20, and is provided with a spherical valve body 36 that is turnably arranged in a seat 37 within the tube part 33. The valve body 36 has a pipe shaped bore 38 with an upper opening 38*a* and a lower opening 38*b* normally facing the upper and the lower portions 33*a*, 33*b*, respectively, of the tube part 33. The bore 38 has mainly the same diameter as the tube part 33, and the bore has a further opening 38*c* normally facing the seat 37. The tube part 33 is provided with an opening 33*c* which is normally covered by the valve body 36. The valve body is also provided with turning means 39 at each side of the tube part 33.

Each turning means 39 is designed as sector of a circle having teeth 40 that are in engagement with a rack gear 41. The rack gear is secured in the holder 35 and is parallel to the longitudinal axis of the tube part 33. The holder 35 is also provided with a chamber 42 surrounding the seat 37. The length of the chamber 42 is such that it allows the tube part 33, together with the valve body 36, to be moved longitudinally (upwards and downwards in FIG. 3) with respect to the holder 35. The chamber 42 is provided with an opening 43 facing an air channel 44 in the holder 35. The air channel 44 extends to a bottom part 45 of the holder 35. The channel 44 is, via an opening 46, connected to a chamber 47 in which the feather duster 20 is inserted. Preferably, the chamber 47 is surrounded by a transparent tube 48. The feather duster 20 is inserted into the chamber 47 via an opening 49 normally closed by a collar 50 applied on the feather-duster and serving as a cover for the opening 49. At the upper part of the chamber 47 there is an inlet 51 for air. The inlet 51 is preferably arranged such that the air flows tangentially into the chamber 47.

The device according to FIGS. 3–5 operates in the following manner. During normal vacuum cleaning operations the feather duster is stored in the chamber 47 and can easily be taken out in order to remove dust from objects. After inserting the feather duster again into the chamber 47, the operator can choose to remove the dust from the feather duster by pulling the complete holder 35 longitudinally upwards in FIG. 3 with respect to the tube shaft and tube handle which are secured to the tube part 33. This means that the teeth 40 of the turning means 39, by their engagement with the rack gear 41, turn the valve body 36 clockwise 90° such that the opening 38*a* of the bore 38 comes into alignment with the opening 33*c* of the tube part 33 at the same time as the opening 43 moves to a position in which it comes into alignment with the openings 33*c* and 38*a*. Simultaneously, the communication between the upper and lower tube portions is blocked by means of the valve body 36. This means that air which has previously been drawn from the vacuum cleaner nozzle 15 through the tube shaft 16, the tube portions 33*b* and 33*a* and further into the tube handle 17 is now instead sucked through the opening 51, the chamber 47, the channel 44, the openings 43, 33*c*, 38*a* and the upper portion 33*a*. Consequently, the air which flows tangentially into the tube 48 will circulate in the chamber 47 and create a cyclonic effect thereby shaking the complete feather-duster, removing particles from the feather-duster 20 and delivering them to the vacuum cleaner housing at the same time as the threads and/or fibers of the feather duster vibrate and are charged with static electricity. The dust removal from the feather duster can then easily be interrupted by pushing the holder 35 downwards. This means that the valve body 36 is turned counterclockwise and returns to the initial position shown in FIG. 3.

The threads of the duster-feather should be manufactured from a material that differs from the material of the surrounding wall the choice of material being such that the different materials are heavily separated from one another in the so called triboelectrical serie in order to achieve a high static charging of the feather-duster.

Although the foregoing description relates to a method for cleaning a duster-feather, the same method can be used for cleaning a duster. Then, it is of course suitable to adapt the holder 19 and hence the chamber 21 and the opening 26 to the shape of the duster as well as providing the holder or the duster with some kind of means for securing the duster to the vacuum cleaner during the vacuum cleaning and charging operation.

It should also be mentioned that even if the embodiment described above relates to so called canister vacuum cleaners it could as well be used for so called upright vacuum cleaners.

The holder preferably is placed close to the hands of the operator but it can, course, be placed at a suitable place on the vacuum cleaner. It is also possible to provide the vacuum cleaner with some kind of electrically or pneumatic driven means that can be activated in order to shake the duster or the feather-duster during the cleaning operation.

In case a feather-duster is used it is preferably provided with a telescopic shaft by means of which the length of the shaft can be adjusted such that it suits the actual use.

It is also possible to use the cylindrical chamber as a holder for the feather-duster or duster for so called cyclone vacuum cleaners, i.e. vacuum cleaners in which the dust is separated from the air flow in a cylindrical chamber by means of cyclone effect, during the cleaning and/or charging stage.

As an alternative the dust pick-up tool might be inserted into the holder and be cleaned by other means than the air flow whereby the dust is removed from the tool and collected in the chamber. When the valve is later opened the chamber will be cleaned separately or together with the feather-duster or the duster.

What is claimed is:

1. A device for a vacuum cleaner having a vacuum source (12) communicating with an inlet channel and an outlet channel for air flowing through the vacuum cleaner, wherein the vacuum cleaner comprises a holder (19,35) for a dust pick up tool, the holder defining a chamber (21,47) which, by means of a valve (28,30,36), is connected to one of said inlet channel and said outlet channel such that the tool and/or the chamber (21,47) is cleaned by means of air flowing through the chamber.

2. The device for a vacuum cleaner according to claim 1, wherein said dust pick-up tool is selected from the group consisting of feather dusters and micro fiber dusters.

3. The device according to claim 1, wherein the chamber (21,47) has at least one air inlet (22,23,51) and at least one air outlet (27,46), said at least one air outlet being arranged to communicate with said inlet channel.

4. The device according to claim 3, wherein the chamber (21,47) is defined by a cylinder, said at least one inlet (22,51) being placed at one end of the cylinder and said at least one outlet (27,46) being arranged at the other end of the cylinder.

5. The device according to claim 4, wherein the cylinder is closed by a cover (25) having a central opening (26) through which a part of the dust pick-up tool is inserted into the chamber (21).

6. The device according to claim 1, wherein the valve (28,30) is activated by the dust pick-up tool.

7. The device according claim 1, wherein the holder (35) is provided with a valve body (36) and a tube part (33), said tube part being slidably arranged in the holder and forming a part of the inlet channel, said valve body (36) being moved from a first position to a second position by means of the sliding motion of the holder (35) with respect to the tube part (33).

8. The device according to claim 7, wherein the tube part comprises an upper portion **(33*a*) and a lower portion (33*b*) that are separated by the valve body (36) which, in a first position under normal vacuum cleaning work, covers a tube part opening (33*c*) at the same time as air flows from the lower to the upper portion, the holder being provided with a holder opening (43) communicating with the chamber (47) via an air passage (44), the tube part being movable to a second position in which the tube part opening (33*c*) is aligned with the holder opening (43) while the valve body is turned such that communication between the upper and lower tube portions (33*a*, 33*b*) is interrupted simultaneously as communication is established between the holder opening (43) and the upper portion (33*a*)** of the tube part.

9. The device according to claim 8, wherein the valve body (36) and the holder (35) are provided with a rack and pinion arrangement (39,40,41) in order to turn the valve body when the tube part (33) is moved with respect to the holder.

10. The device according to claim 9, wherein the dust pick-up tool has a shaft that is shaped as a telescopically extendable unit.

11. The device according to claim 9, wherein the holder (21) is arranged adjacent a handle unit (17) of the vacuum cleaner.

* * * * *